US009022480B2

(12) United States Patent
Hazzard et al.

(10) Patent No.: US 9,022,480 B2
(45) Date of Patent: May 5, 2015

(54) NO-TOOLS CHAIR AND CHAIR ARM ASSEMBLY

(71) Applicant: Whalen Furniture Manufacturing Inc., San Diego, CA (US)

(72) Inventors: Thomas B. Hazzard, Ladera Ranch, CA (US); Tracy Leigh Hazzard, Ladera Ranch, CA (US)

(73) Assignee: LF Centennial Limited, Tortola (VG)

( * ) Notice: Subject to any disclaimer, the term of this patent is extended or adjusted under 35 U.S.C. 154(b) by 144 days.

(21) Appl. No.: 13/736,461

(22) Filed: Jan. 8, 2013

(65) Prior Publication Data

US 2014/0191551 A1 Jul. 10, 2014

(51) Int. Cl.

| | |
|---|---|
| ***A47C 7/54*** | (2006.01) |
| ***A47C 4/02*** | (2006.01) |
| ***A47C 7/40*** | (2006.01) |

(52) U.S. Cl.

CPC ... *A47C 7/54* (2013.01); *A47C 4/02* (2013.01); *A47C 7/407* (2013.01)

(58) Field of Classification Search

CPC ..... B60N 2/20
USPC ..... 297/411.23, 411.24, 411.25, 411.26, 297/411.27, 411.3, 378.1, 378.12
See application file for complete search history.

(56) References Cited

U.S. PATENT DOCUMENTS

| | | | | |
|---|---|---|---|---|
| 8,029,014 | B2 * | 10/2011 | Ahnert et al. | 280/650 |
| 2004/0124677 | A1 * | 7/2004 | Meeker et al. | 297/255 |
| 2007/0236061 | A1 * | 10/2007 | Meeker et al. | 297/250.1 |
| 2008/0224513 | A1 * | 9/2008 | Zink et al. | 297/250.1 |
| 2008/0224514 | A1 * | 9/2008 | Zink et al. | 297/255 |
| 2010/0117423 | A1 * | 5/2010 | Lin | 297/316 |
| 2010/0308552 | A1 * | 12/2010 | Mival et al. | 280/47.4 |
| 2011/0309658 | A1 * | 12/2011 | Carimati Di Carimate et al. | 297/68 |

* cited by examiner

*Primary Examiner* — David R Dunn
*Assistant Examiner* — Jody Giacoman
(74) *Attorney, Agent, or Firm* — Barlow, Josephs & Holmes, Ltd.

(57) ABSTRACT

A no-tools chair and chair arm assembly is disclosed. The assembly includes an armrest support configured and arranged to connect to a seat of a chair. The armrest support has mating formations thereon. A backrest support is configured and arranged to connect to a backrest of a chair. The backrest support is pivotally connected to the armrest support. A chair arm has an armrest portion and support member depends from the armrest portion. A connector extends from the support member and has reciprocal mating formations thereon configured and arranged to interlock with the mating formations on the armrest support. The chair arm locks the backrest support in position when coupled to the armrest portion.

15 Claims, 10 Drawing Sheets

NO-TOOLS CHAIR AND CHAIR ARM ASSEMBLY

BACKGROUND OF THE INVENTION

1. Field of the Invention

This patent document relates generally to chairs and more specifically to a chair arm assembly that requires no tools to assemble and provides a smaller form factor for the chair for convenient shipping and storage.

2. Background of the Related Art

Chairs, such as office swivel chairs, are often assembled by the end customer. Assembling the chair requires that the customer have certain tools, such as screwdrivers, Allen wrenches and conventional wrenches. However, customers do not all possess these tools and have various mechanical aptitude for assembling components together. Therefore, it is desirable that the chair, to the extent possible, come as pre-assembled as possible to minimize the inconvenience to the customer.

Weighing against this situation is that it is also desirable that the chair be as compact as possible during shipping and storage. Understandably, a preassembled chair occupies a larger volume than a disassembled chair. The main obstacle to overcoming this problem is the backrest, seat cushion and chair arms (if provided) of the chair, which occupies a significant volume of space when assembled together.

Therefore, there is a need in the art for a chair and chair arm assembly that can be easily assembled or require minimal assembly, and that requires no tools, yet is still compact for shipping and storage.

SUMMARY OF THE INVENTION

The present invention solves the problems of the prior art by providing a no-tools chair arm assembly that enables a chair, such as an office swivel chair, to be shipped and stored in a smaller form factor. Furthermore, the assembly permits a variety of chair arm configurations (or none at all) to be used as desired by the customer.

The assembly includes an armrest support configured and arranged to connect to a seat cushion of a chair. The armrest support has mating formations thereon. A backrest support is configured and arranged to connect to a backrest of a chair. The backrest support is pivotally connected to the armrest support. A chair arm has an armrest portion and support member depends from the armrest portion. A connector extends from the support member and has reciprocal mating formations thereon configured and arranged to interlock with the mating formations on the armrest support. The chair arm locks the backrest support in position when coupled to the armrest portion.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
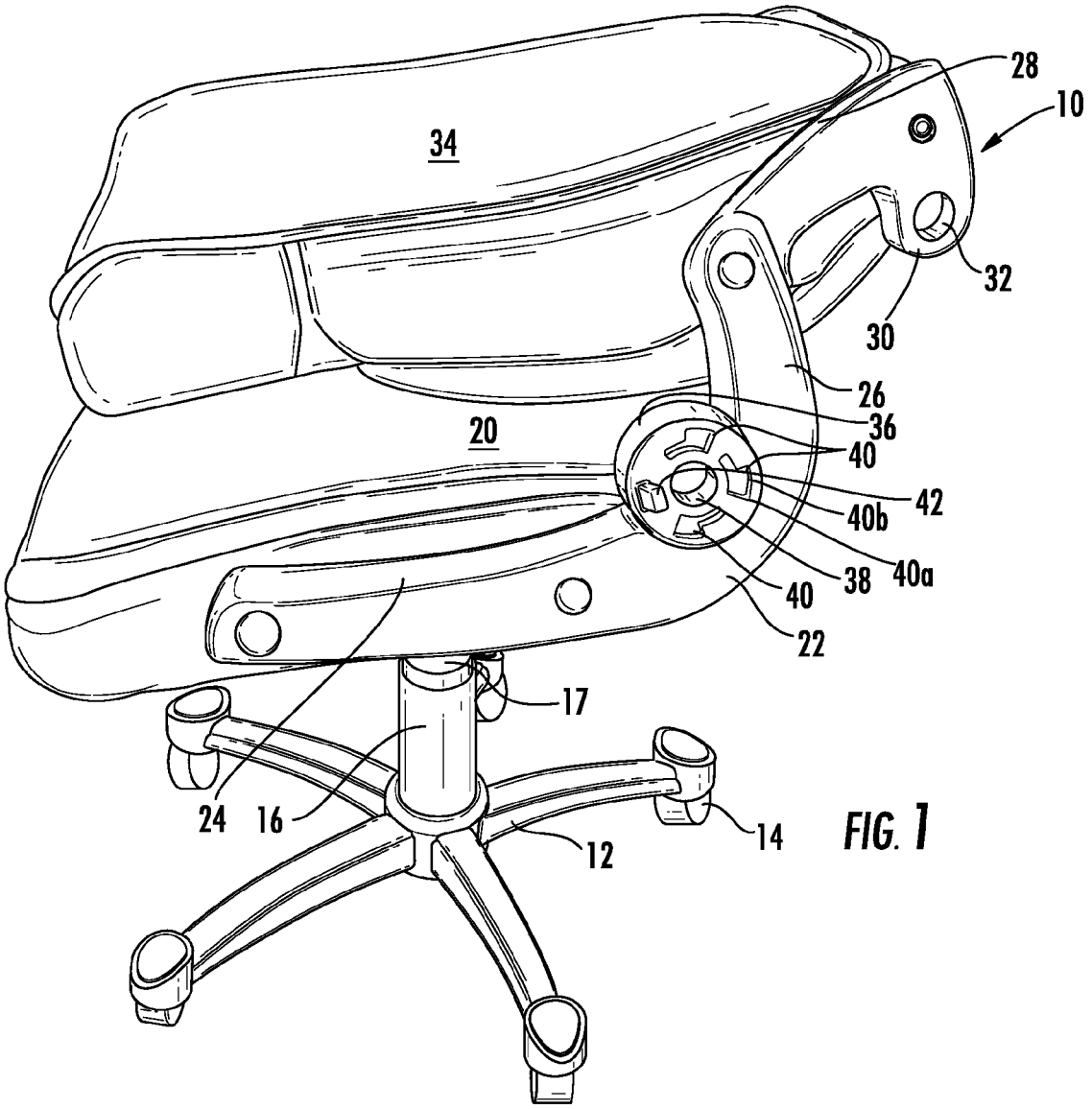
FIG. 1 is a left perspective view of an embodiment of a chair and no-tools chair arm assembly with a backrest of the chair in a folded position for convenient shipping and storage.
Figure 2:
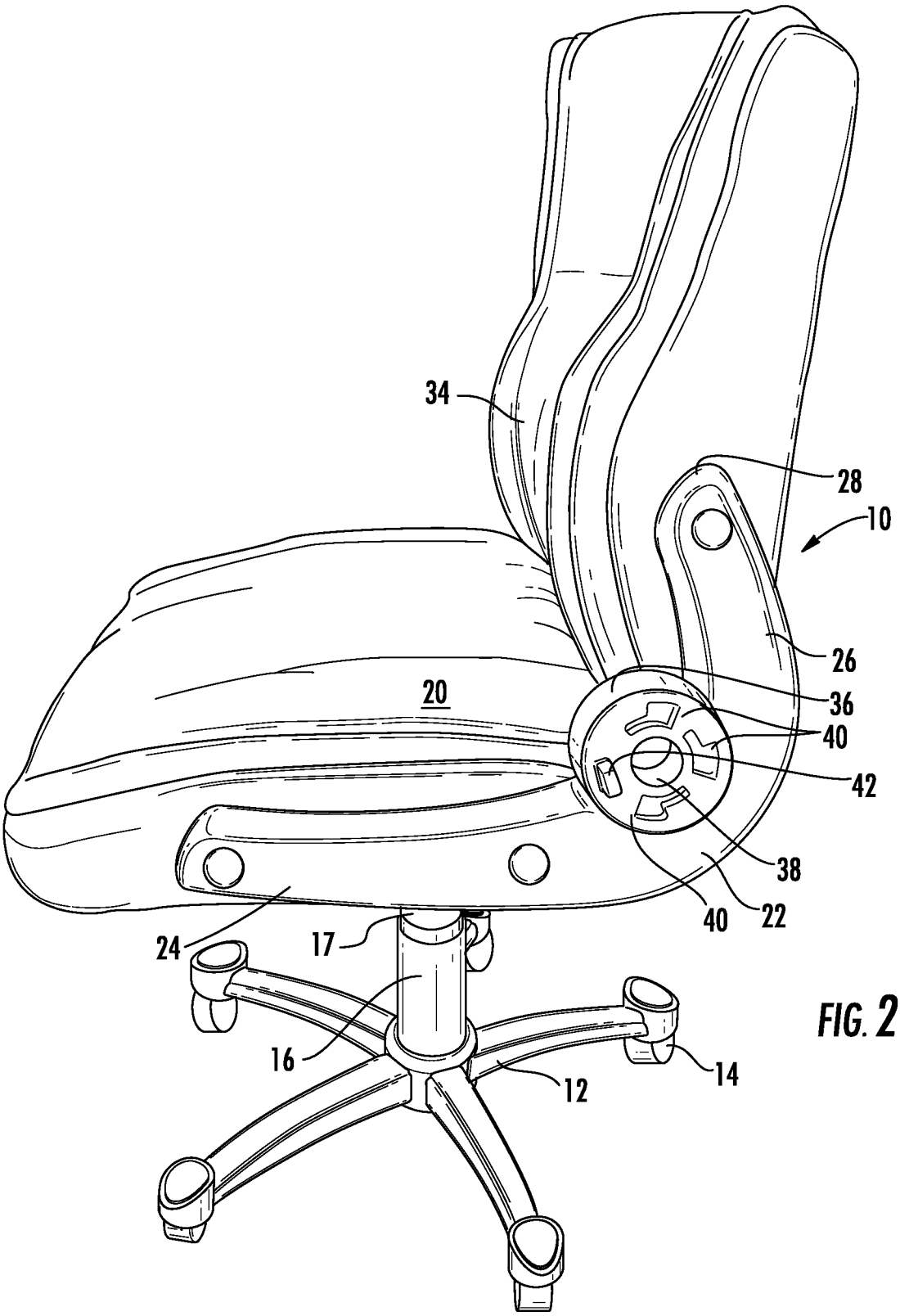
FIG. 2 is a left perspective view of an embodiment of a chair and no-tools chair arm assembly with a backrest of the chair extended upright.

Referring to FIGS. 1 and 2, a chair, such as an office swivel chair, having the no-tools arm assembly is shown generally at 10. The chair 10 includes a base 12 with casters 14. A telescoping cover 16 encloses a gas lift 17, which is connected to a mechanism 18 to adjust the chair 10 height and tilt. The mechanism 18 includes a support plate to which a seat cushion 20 is secured at the top of the mechanism 18.

A right and a left armrest support 22 are connected to each side of the seat cushion 20. Only the left armrest support is shown 22, but it is to be understood that the right armrest is the mirror image thereof. Each armrest support 22 includes a lower member 24, connected to the seat cushion 20 and an upper member 26 extending from a rear portion of the lower member 24.

Pivotally connected to the upper member 26 is a backrest support 28. The backrest support 28 further includes a lock member 30 extending from a lower end of the backrest support 28. The lock member 30 has an aperture 32 formed therethrough. As will be further described below, the lock member 30 is pinned via the aperture 32 to prevent the backrest support 28 from pivoting. A backrest 34 is connected between the two backrest supports 28 and may be pivoted between a lower, unlocked position for compact shipping and storage (best seen in FIG. 1), and an upright position for use (best seen in FIG. 2).

Near the joint formed between the lower member 24 and the upper member 26 of the armrest support 22 is an armrest base 36. The armrest base 36 includes an aperture 38 formed therethrough. Spaced around the aperture 38 are three mating formations 40 configured to receive reciprocal mating formations 54 on the chair arm 44, described further below. The mating formations 40 shown include a slot 40*a* with a narrowed portion 40*b*. However, other mating formations may be used. For instance, the mating formations may have a keyhole shape instead. Furthermore the mating formations 40 may include rounded slot 40*a* and end of the narrowed portion 40*b*. A spring button 42 extends from the armrest base 36 and, as will be described further below, is configured to engage an aperture 56 on the chair arm 44.

Figure 3:
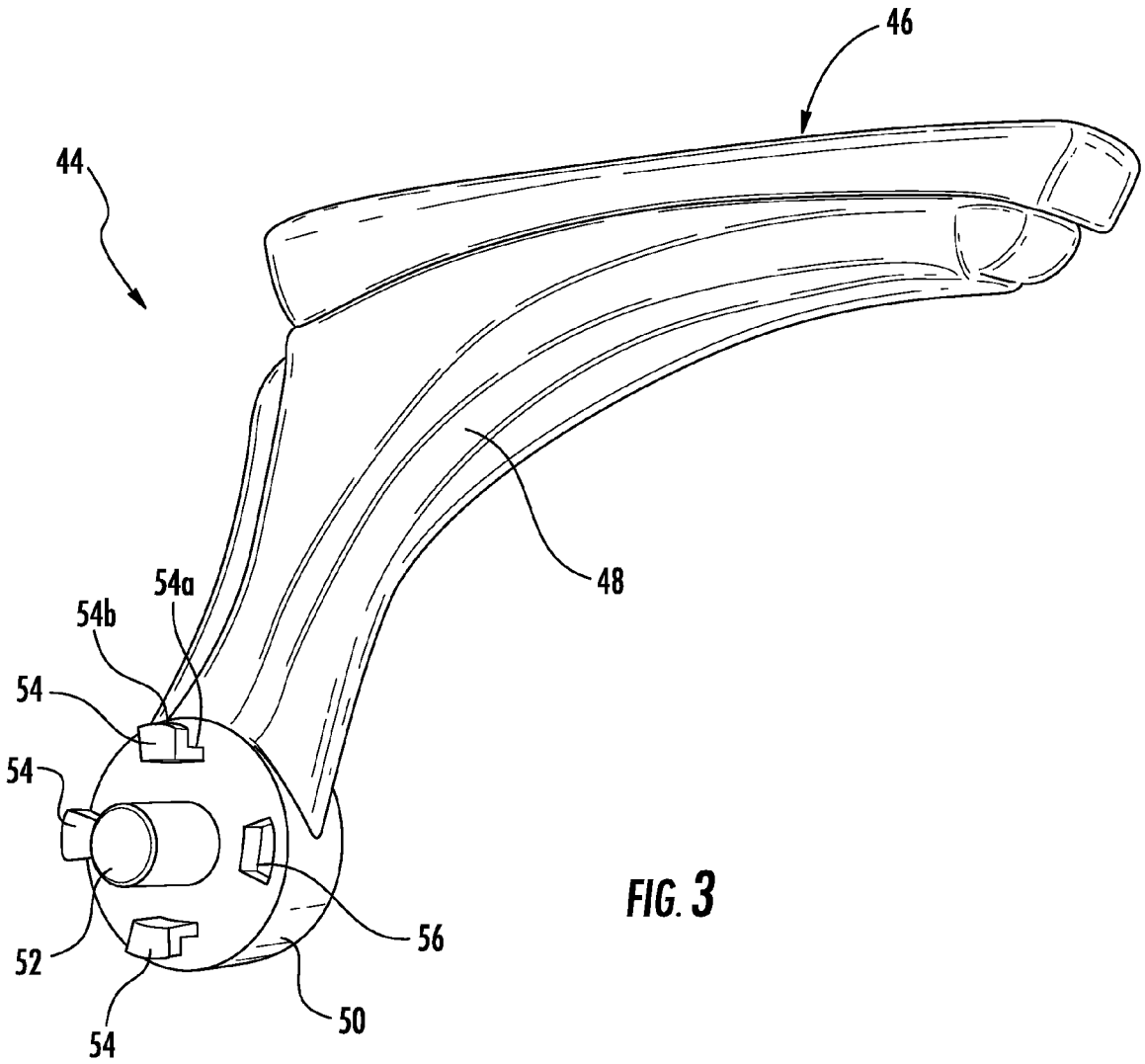
FIG. 3 is a right perspective view of a chair arm of the no-tools chair arm assembly.

Referring to FIG. 3, a chair arm 44 is shown. The chair arm 44 includes an armrest portion 46. A support member 48 depends below the armrest portion 46. At the end of the support member 48 is a connector 50 configured to couple to the armrest base 36 on the armrest support 22. The connector 50 includes a peg 52 configured to engage the aperture 38 on the armrest base 36 and the aperture 32 on the lock member 30 of the backrest support 28, thereby pinning them together. Reciprocal mating formations 54 extending from the connector 50 engage and interlock with the mating formation 40 on the armrest base 36. The reciprocal mating formations 54 include a projection 54*a* with an enlarged portion 54*b*. However, other reciprocal mating formations 54 may be used. For instance, the reciprocal mating formation may be round projection with an enlarged head, which could be round as well. An aperture 56 on the connector 50 interlocks with the spring button 42 on the armrest base 36. A decorative end cap (not shown) may be coupled to the connector 50.

Figure 4:
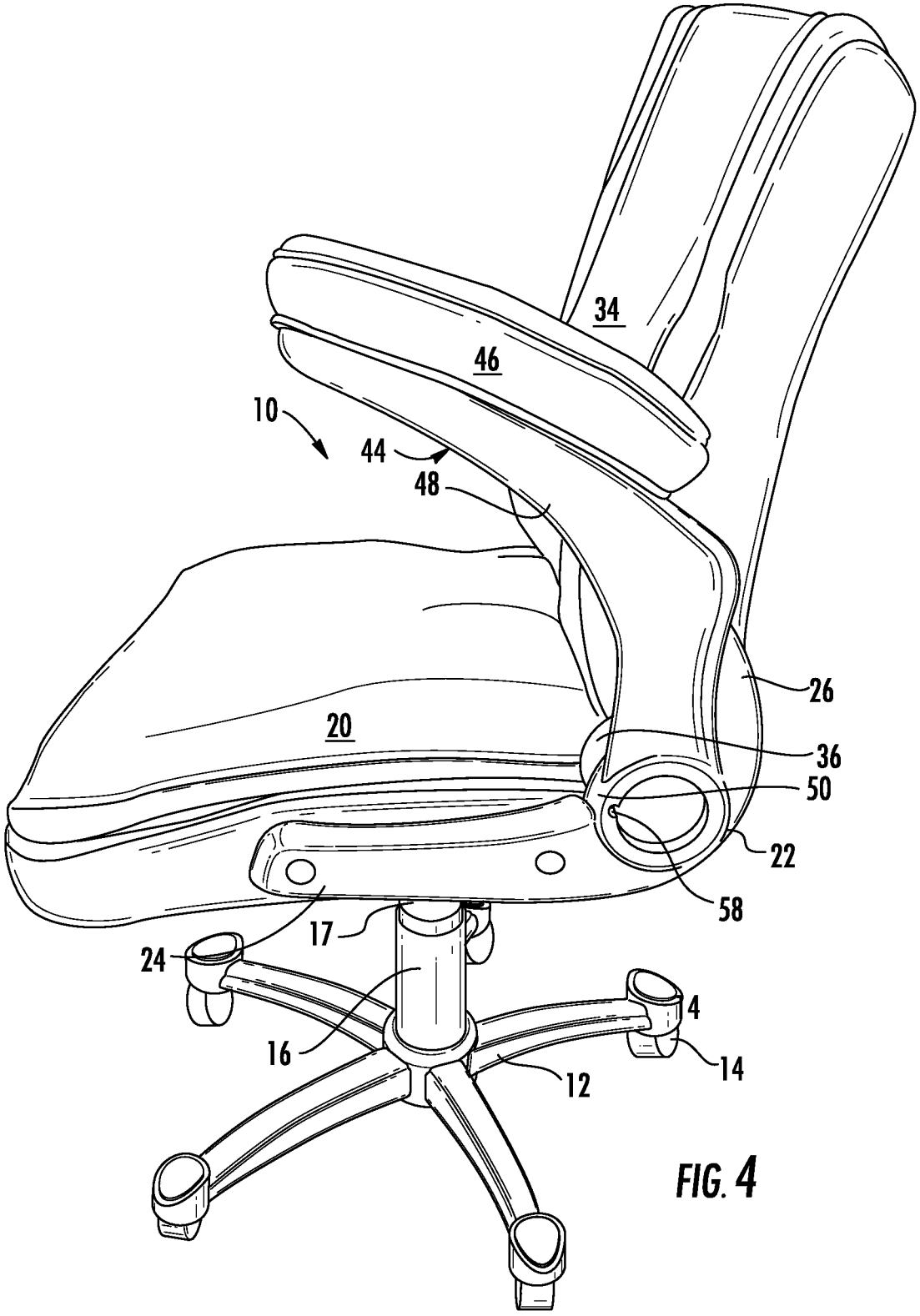
FIG. 4 is a left perspective view of the chair arm engaging the armrest support in an unlocked position.
Figure 5:
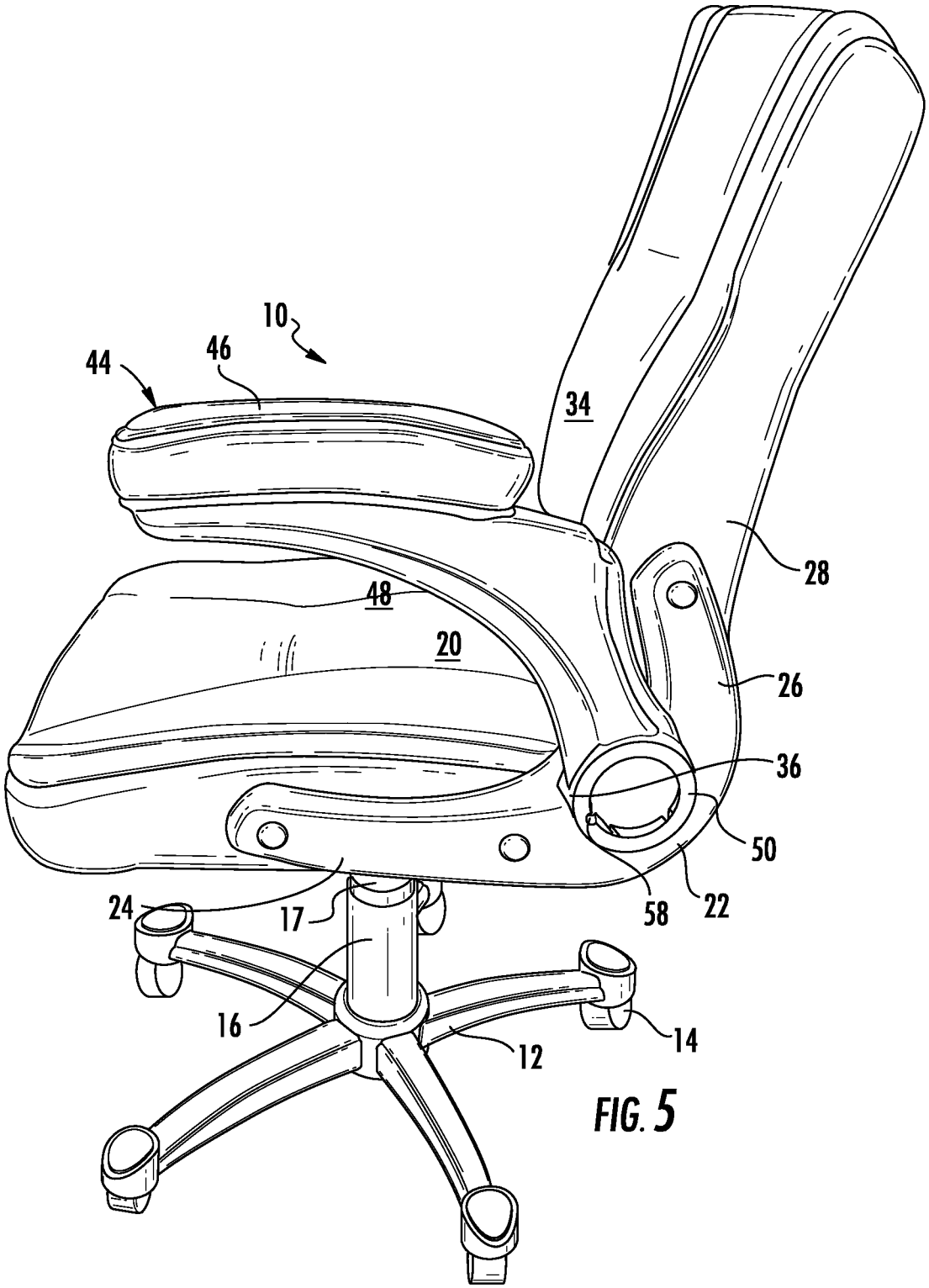
FIG. 5 is a left perspective view of the chair arm rotated forward to a locked position.

Referring now to FIGS. 4 and 5, the manner of how the chair arm 44 is locked to the armrest support 22 is shown. Specifically, the peg 52 on the connector 50 engages the aperture 38 on the armrest base 36 and the aperture 32 on the lock member 30 on the backrest support 28. The reciprocal mating formations 54 are aligned with the mating formations 40 to allow the connector 50 to be fully seated against the armrest base 36. The chair arm 44 is then rotated forward, locking the mating formations 40 and reciprocal mating formations 54 together. Because the reciprocal mating formations 54 include a projection 54*a* with an enlarged portion 54*b* and the mating formations 40 include a slot 40*a* with a narrowed portion 40*b*, the enlarged portion 54*b* on the projection 54*a* becomes locked behind the narrowed portion 40*b* of the slot 40*a*. Because the peg 52 engages the aperture 32 on the lock member 30 of the backrest support 28, the backrest support 28 is prevented from pivoting, thereby retaining the backrest 34 in an upright position.

The spring button 42 engages the aperture 56 on the connector 50, preventing the chair arm 44 from being rotated back to an unlocked state. The chair arm 44 may be removed by depressing the spring button 42 via an access hole 58, which extends into aperture 56, on the connector 50. Once the spring button 42 is released from aperture 56, the chair arm 44 may then be rotated back up to disengage the mating formations 40 and reciprocal mating formations 52 from each other.

Figure 6:
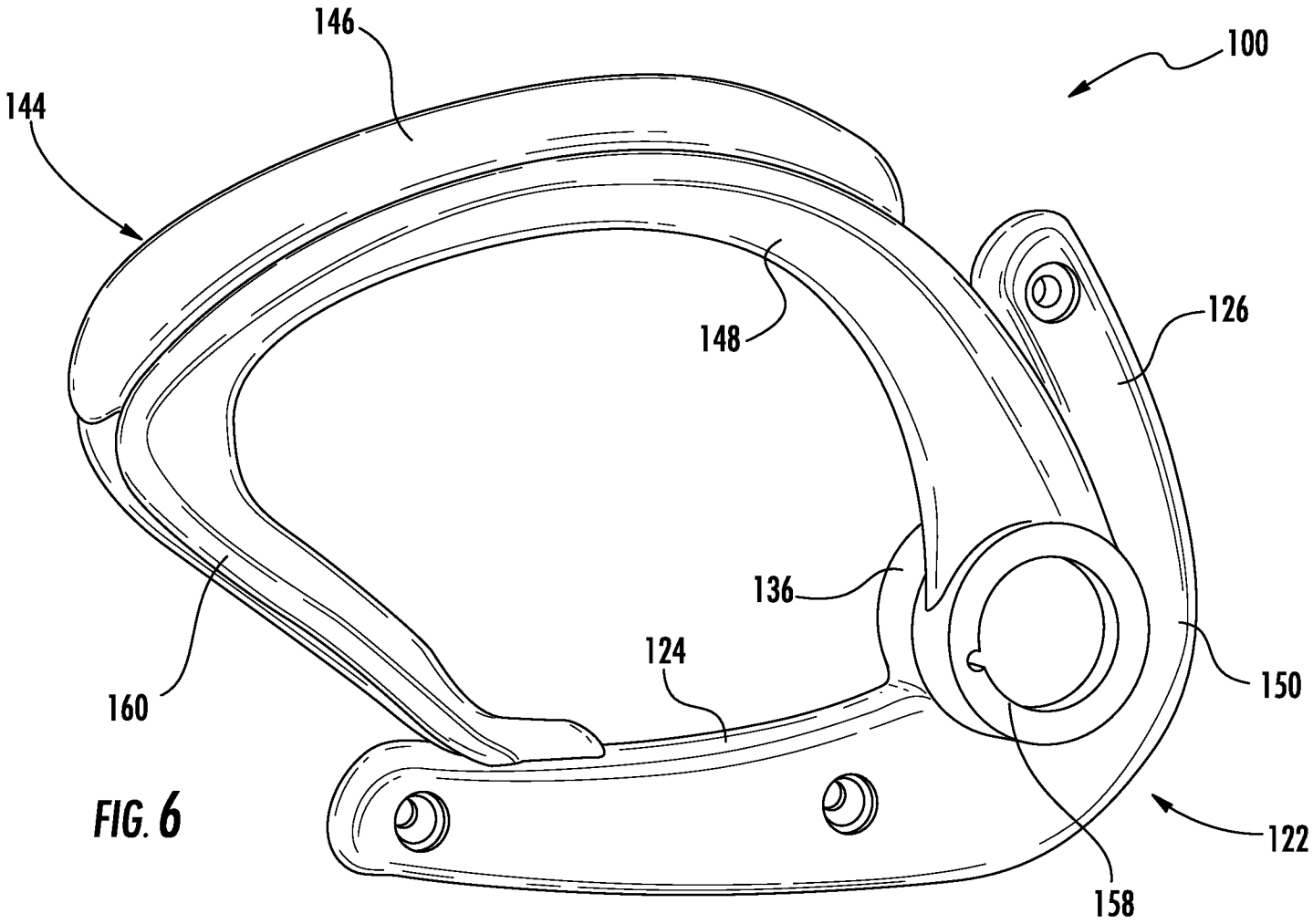
FIG. 6 is a left perspective view of an alternative embodiment of the no-tools chair arm assembly.

Referring to FIG. 6, an alternative embodiment of a no-tools chair arm assembly is shown generally at 100. The alternative embodiment 100 generally includes all of the same features as the first embodiment 10 described above, but also includes a forward support member 160 on a chair arm 144 that interlocks with an armrest support 122. As can be appreciated, the alternative embodiment 100 provides a more durable chair arm assembly 144 with an alternative appearance that is also aesthetically pleasing.

Figure 7:
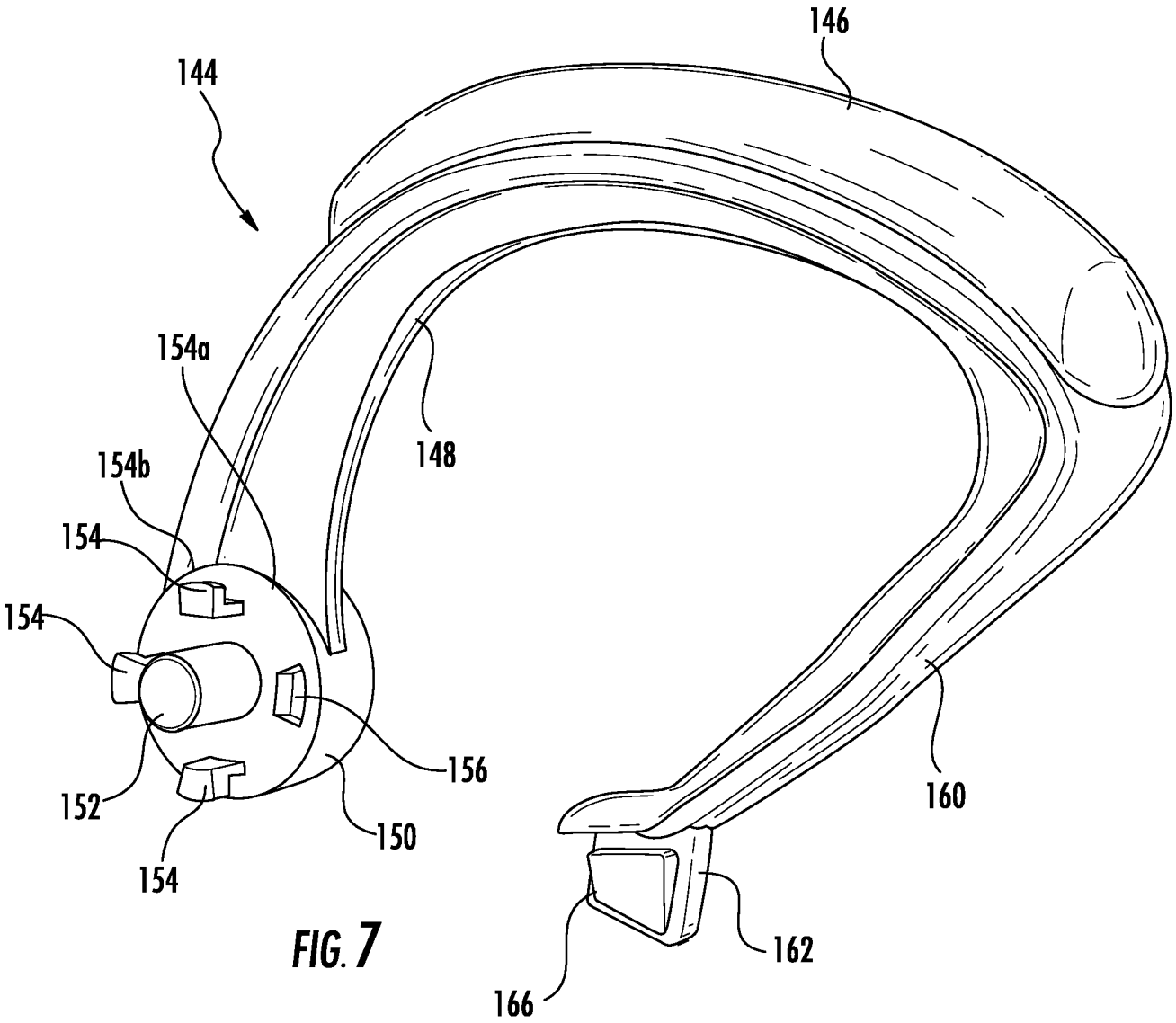
FIG. 7 is a right perspective view of an alternative embodiment of a chair arm of the no-tools chair arm assembly.

Referring to FIG. 7, the alternative chair arm 144 is shown. The chair arm 144 includes an armrest portion 146. A rear support member 148 depends below the armrest portion 146. At the end of the rear support member 146 is a connector 150 configured to couple to the armrest base 136 on the armrest support 122. The connector 150 includes a peg 152 configured to engage the aperture 38 on the armrest base 122 and the aperture 32 on the backrest support 28, thereby pinning them together. Reciprocal mating formations 154 extending from the connector 150 engage and interlock with the mating formation 40 on the armrest base 136. The reciprocal mating formations 154 include a projection 154*a* with an enlarged portion 154*b*. However, other reciprocal mating formations 54 may be used. For instance, the reciprocal mating formation may be a round projection with an enlarged head, which could be round as well. An aperture 156 on the connector 150 interlocks with the spring button 42 on the armrest base 122. A decorative end cap (not shown) may be coupled to the connector 150.

Figure 8:
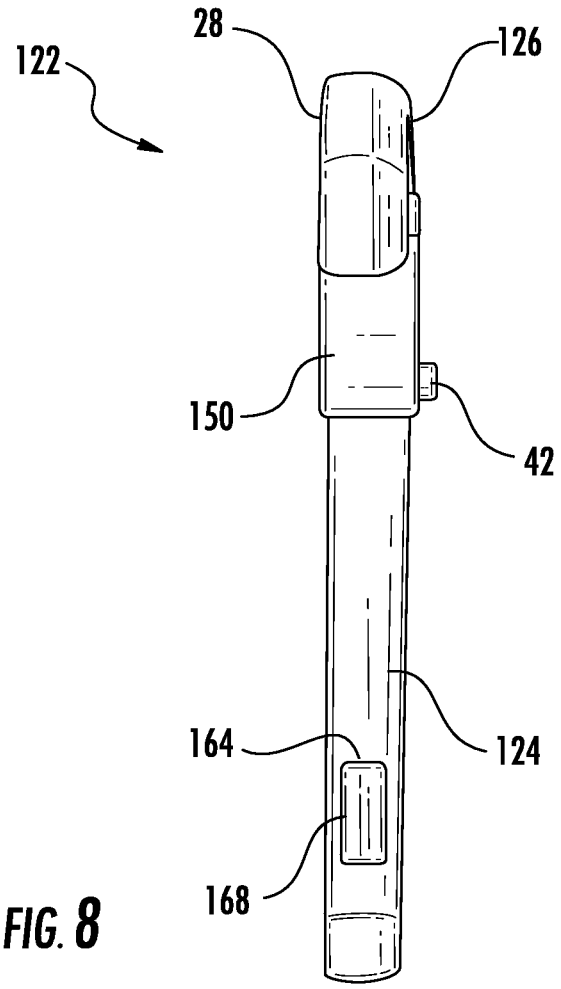
FIG. 8 is a top view of an alternative embodiment of the armrest support of the no-tools chair arm assembly.

A forward support member 160 depends below the armrest portion 146 and includes a locking lug 162 configured to engage a well 164 on the lower portion 124 of the armrest support 122. The locking lug 162 includes a spring button 166 configured to be received in an aperature 168 located in the well 164 of the in the armrest support 122 (best seen in FIG. 8).

Figure 9:
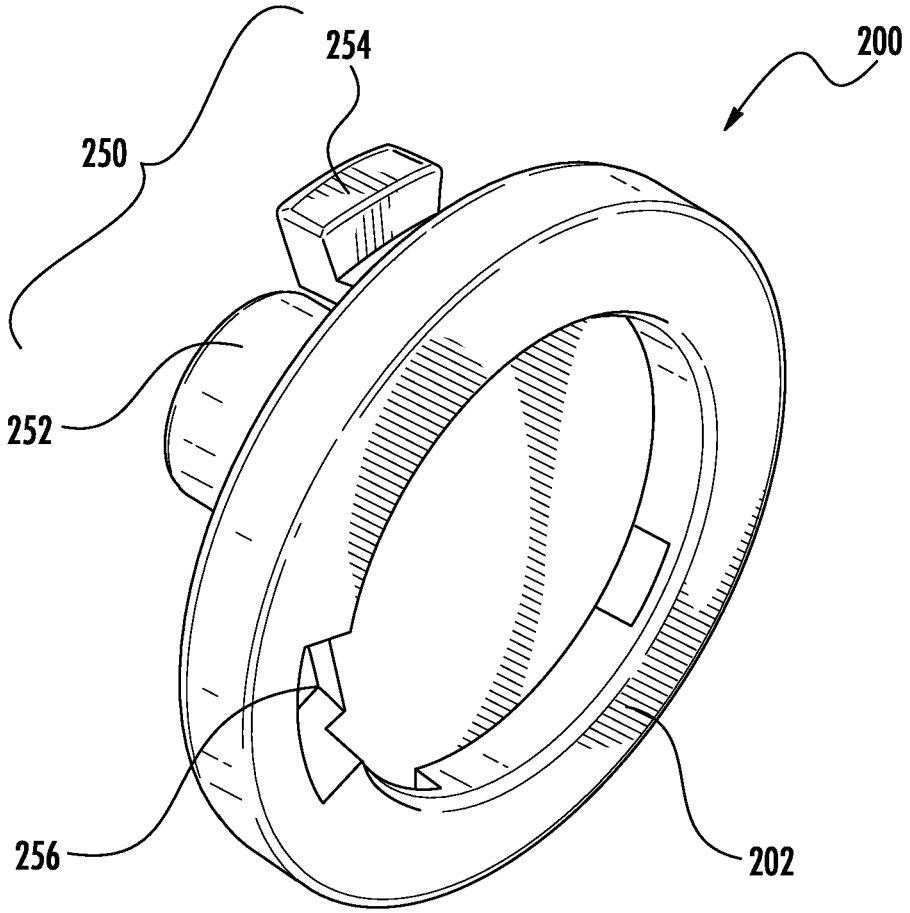
FIG. 9 is a front perspective view of an alternative embodiment of a locking end cap of the no-tools chair arm assembly.
Figure 10:
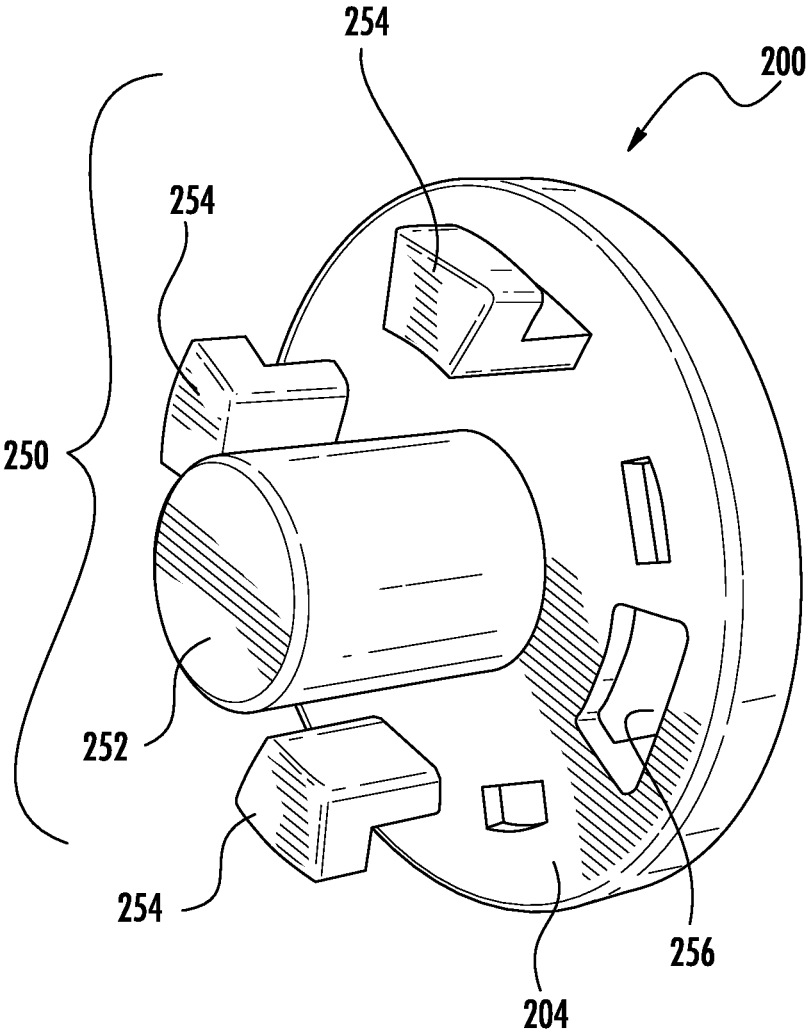
FIG. 10 is a rear perspective view of an alternative embodiment of a locking end cap of the no-tools chair arm assembly.

Referring to FIGS. 9 and 10, a locking end cap 200 is shown, which may be used for a chair 10 where no armrests 44, 144 are desired. The locking end cap 200 is configured to recieve a decorative end cap (not shown) attached on the front 202 (best seen in FIG. 9) and a connector 250 on the rear 204 (best seen in FIG. 10). The connector 250 is configured to couple to the armrest base 36, 136 on the armrest support 22, 122. The connector includes a peg 252 configured to engage the aperture 40, 140 on the armrest base 36, 136 and the aperture 30 on the backrest support 28, thereby pinning them together. Reciprocal mating formations 254 extending from the connector 250 engage and interlock with the mating formations 40, 140 on the armrest base 22, 122. An aperture 256 on the connector 250 interlocks with the spring button 42 on the armrest base 22, 122.

Therefore, it can be seen that the present invention provides a unique solution to the problem of providing a chair that requires no-tools to assemble yet still has a compact form factor for shipping and storage.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A no-tools chair arm assembly, comprising:

an armrest support configured and arranged to connect to a seat of a chair, the armrest support having mating formations thereon, and a surface defining an aperture therethrough;

a backrest support configured and arranged to connect to a backrest of a chair, the backrest support pivotally connected to the armrest support, the backrest support further comprising a lock member having an aperture; and a chair arm having an armrest portion and a support member depending from the armrest portion, and a connector extending from the support member having reciprocal mating formations thereon configured and arranged to interlock with the mating formations on the armrest support;

the chair arm configured and arranged to lock the backrest support in position when coupled to the armrest portion, wherein the aperture on the lock member aligns with the aperture on the support member when the backrest support is pivoted to an upright position and the connector comprises a peg extending therefrom that interfits with the aperture on the backrest support and the aperture on the support member.

2. The assembly of claim 1, wherein the mating formations include a slot with a narrowed portion.

3. The assembly of claim 1, wherein the reciprocal mating formations include a projection with an enlarged portion.

4. The assembly of claim 1, wherein the chair arm further comprises a front support configured and arranged to couple to the armrest support.

5. The assembly of claim 4, wherein armrest support further comprises a well and the front support has a locking lug with spring button extending therefrom, the locking lug configured and arranged to insert into the well, the well further having aperture therein configured and arrange to receive the spring button of the locking lug thereon.

6. A no-tools chair arm assembly, comprising:

an armrest support configured and arranged to connect to a seat of a chair, the armrest support having mating formations thereon;

a backrest support configured and arranged to connect to a backrest of a chair, the backrest support pivotally connected to the armrest support; and a chair arm having an armrest portion and support member depending from the armrest portion, a connector extending from the support member having reciprocal mating formations thereon configured and arranged to interlock with the mating formations on the armrest support;

the chair arm configured and arranged to lock the backrest support in position when coupled to the armrest portion; and a spring button on the support member configured and arranged to interlock with the connector.

7. A no-tools chair arm assembly, comprising:

an armrest support configured and arranged to connect to a seat of a chair, the armrest support having mating formations thereon;

a backrest support configured and arranged to connect to a backrest of a chair, the backrest support pivotally connected to the armrest support; and a chair arm having an armrest portion, a support member depending from the armrest portion, and a connector extending from the support member having reciprocal mating formations thereon configured and arranged to interlock with the mating formations on the armrest support, the chair arm configured and arranged to lock the backrest support in position when coupled to the armrest portion; and a locking end cap having a decorative face on a front and reciprocal mating formations extending from a rear, the reciprocal mating formations configured and arranged to couple to the mating formations on the armrest support.

8. A chair, comprising:

a seat;

a backrest;

a left armrest support connected to the seat, the left armrest support having mating formations thereon, and a surface defining an aperture therethrough;

a right armrest support connected to the seat, the right armrest support having mating formations thereon, and a surface defining an aperture therethrough;

a left backrest support connected to the backrest, the left backrest support pivotally connected to the left armrest support, the left backrest support further comprising a lock member having an aperture;

a right backrest support connected to the backrest, the right backrest support pivotally connected to the right armrest support, the right backrest support further comprising a lock member having an aperture;

a left chair arm having an armrest portion and support member depending from the armrest portion, and a connector extending from the support member having reciprocal mating formations thereon configured and arranged to interlock with the mating formations on the left armrest support; and a right chair arm having an armrest portion and support member depending from the armrest portion, and a connector extending from the support member having reciprocal mating formations thereon configured and arranged to interlock with the mating formations on the right armrest support;

the left chair arm and the right chair arm configured and arranged to lock the left backrest support and right back rest support in position when coupled to the left armrest portion and right armrest portion, respectively, wherein the apertures on the lock members align with the apertures on the respective support members when the respective backrest supports are pivoted to an upright position, and the respective connectors further comprise a peg extending therefrom that interfits with the respective aperture on the respective backrest support and the respective aperture on the respective support member.

9. The chair of claim 8, further comprising a base connected to the seat.

10. The chair of claim 9, further comprising casters attached depending from the base.

11. The chair of claim 9, wherein the base is connected to the seat via a gas lift, the gas lift configured and arranged to adjust the height of the seat relative to the base.

12. The chair of claim 8, wherein the mating formations on each of the left armrest support and the right armrest support include a slot with a narrowed portion.

13. The chair of claim 8, wherein the reciprocal mating formations on each of the connectors of the chair arms include a projection with an enlarged portion.

14. A chair, comprising:

a seat;

a backrest;

a left armrest support connected to the seat, the left armrest support having mating formations thereon;

a right armrest support connected to the seat, the right armrest support having mating formations thereon;

a left backrest support connected to the backrest, the left backrest support pivotally connected to the left armrest support;

a right backrest support connected to the backrest, the right backrest support pivotally connected to the right armrest support;

a left chair arm having an armrest portion and support member depending from the armrest portion, a connector extending from the support member having reciprocal mating formations thereon configured and arranged to interlock with the mating formations on the left armrest support; and a right chair arm having an armrest portion and support member depending from the armrest portion, a connector extending from the support member having reciprocal mating formations thereon configured and arranged to interlock with the mating formations on the right armrest support;

the left chair arm and the right chair arm configured and arranged to lock the left backrest support and right back rest support in position when coupled to the left armrest portion and right armrest portion, respectively; and a spring button on the support member configured and arranged to interlock with the connector.

15. A chair, comprising:

a seat;

a backrest;

a left armrest support connected to the seat, the left armrest support having mating formations thereon;

a right armrest support connected to the seat, the right armrest support having mating formations thereon;

a left backrest support connected to the backrest, the left backrest support pivotally connected to the left armrest support;

a right backrest support connected to the backrest, the right backrest support pivotally connected to the right armrest support;

a left chair arm having an armrest portion and support member depending from the armrest portion, a connector extending from the support member having reciprocal mating formations thereon configured and arranged to interlock with the mating formations on the left armrest support; and a right chair arm having an armrest portion and support member depending from the armrest portion, a connector extending from the support member having reciprocal mating formations thereon configured and arranged to interlock with the mating formations on the right armrest support;

the left chair arm and the right chair arm configured and arranged to lock the left backrest support and right back rest support in position when coupled to the left armrest portion and right armrest portion, respectively; and a left locking end cap and a right locking end cap, each respective end cap having a decorative face on a front and reciprocal mating formations extending from a rear; the reciprocal mating formations configured and arranged to couple to the mating formations on the respective armrest support.

* * * * *